US010724211B2

(12) United States Patent
Quarfordt et al.

(10) Patent No.: US 10,724,211 B2
(45) Date of Patent: Jul. 28, 2020

(54) WEARING-PART SYSTEM

(71) Applicant: COMBI WEAR PARTS AB, Kristinehamn (SE)

(72) Inventors: Per Quarfordt, Storfors (SE); Adnan Gabela, Kristinehamn (SE); Paull Baghramian, Purmerend (NL); Cornelis Wempe, Lunteren (NL); Klaas Geert Wijma, Haarlem (NL)

(73) Assignee: COMBI WEAR PARTS AB, Kristinehamn (SE)

( * ) Notice: Subject to any disclaimer, the term of this patent is extended or adjusted under 35 U.S.C. 154(b) by 92 days.

(21) Appl. No.: 16/303,270

(22) PCT Filed: Apr. 25, 2017

(86) PCT No.: PCT/SE2017/050406

§ 371 (c)(1),
(2) Date: Nov. 20, 2018

(87) PCT Pub. No.: WO2017/204711

PCT Pub. Date: Nov. 30, 2017

(65) Prior Publication Data

US 2020/0181887 A1 Jun. 11, 2020

(30) Foreign Application Priority Data

May 23, 2016 (SE) ..... 1630114

(51) Int. Cl.
*E02F 9/28* (2006.01)
*E02F 3/40* (2006.01)

(52) U.S. Cl.
CPC ..... *E02F 9/2825* (2013.01); *E02F 9/2841* (2013.01); *E02F 3/40* (2013.01);
(Continued)

(58) Field of Classification Search
CPC ..... E02F 9/28; E02F 9/2808; E02F 9/2825; E02F 9/2833; E02F 9/2841; E02F 9/2858; E02F 9/2883; E02F 3/40; E02F 9/2891
(Continued)

(56) References Cited

U.S. PATENT DOCUMENTS 5,713,145 A 2/1998 Ruvang
5,956,874 A 9/1999 Ianello et al.
(Continued)

FOREIGN PATENT DOCUMENTS

CN 102864813 A 1/2013
FR 2878871 A1 6/2006
(Continued)

OTHER PUBLICATIONS

International Search Report (dated Jul. 17, 2017) for corresponding International App. PCT/SE2017/050406.

*Primary Examiner* — Robert E Pezzuto
(74) *Attorney, Agent, or Firm* — WRB-IP LLP

(57) ABSTRACT

A wearing-part holder includes a first stop surface, which is arranged on the front portion of the wearing-part holder, a first contact surface and a second contact surface symmetrically arranged from a centre line L-L from the first stop surface of the wearing-part holder to a second stop surface and a third stop surface, where the second stop surface and the third stop surface are symmetrically arranged on each side of the centre line L-L from the first contact surface and the second contact surface to a third contact surface and a fourth contact surface, where the third contact surface and the fourth contact surface are symmetrically arranged on each side of the centre line L-L from the second stop surface and the third stop surface. A wearing part and a wearing-part system are also provided.

10 Claims, 10 Drawing Sheets

(52) U.S. Cl.
CPC ..... *E02F 9/2858* (2013.01); *E02F 9/2883* (2013.01); *E02F 9/2891* (2013.01)

(58) Field of Classification Search
USPC ..... 37/446, 452–460; 172/701.1–701.3
See application file for complete search history.

(56) References Cited

U.S. PATENT DOCUMENTS

| | | | | |
|---|---|---|---|---|
| 6,209,238 | B1 | 4/2001 | Ruvang | |
| 6,321,471 | B2 * | 11/2001 | Fernandez Munoz | E02F 9/2841 37/456 |
| 6,836,983 | B2 * | 1/2005 | Pallas Moreno | E02F 9/2825 37/452 |
| 6,871,426 | B2 * | 3/2005 | Keech | E02F 9/2825 37/456 |
| 2009/0000159 | A1 * | 1/2009 | Breken | E02F 9/2858 37/455 |
| 2013/0185965 | A1 * | 7/2013 | Bartolome Rodriguez | E02F 9/2833 37/453 |
| 2014/0360062 | A1 * | 12/2014 | Marchand | E02F 9/2825 37/455 |
| 2017/0067230 | A1 * | 3/2017 | Perez Soria | E02F 9/2833 |
| 2017/0328035 | A1 * | 11/2017 | Bilal | E02F 9/2825 |

FOREIGN PATENT DOCUMENTS

| | | | |
|---|---|---|---|
| WO | 9721880 | A1 | 6/1997 |
| WO | 9916982 | A1 | 4/1999 |
| WO | 2010111015 | A2 | 9/2010 |

* cited by examiner

WEARING-PART SYSTEM

BACKGROUND AND SUMMARY

The present invention relates to a wearing-part system which comprises a wearing-part holder and a wearing part.

Various types of devices for dredging, such as dredgers, bucket dredgers or other types of machines intended to excavate or otherwise work or move material or sediment, mainly under water, usually use teeth or another replaceable wearing part or tool mounted on the cutter head, the bucket or the apparatus that is used to work or move the material. For machinery designed to work the material or sediment using teeth, wear in most cases occurs on the teeth with which the machinery is equipped. The teeth are designed to be able to be replaced after they have become worn, and the teeth are designed to work or clear in different ways the material or sediment that is to be worked by the machinery.

A wearing part such as a tooth is mounted on the machinery, such as a cutter head on a dredger, for example by a screw joint or cotter joint. Various types of thermal assembly, such as welding or shrink-fitting, are other known assembly methods. The tooth can be mounted on a wearing-part holder or tool holder and replaced on a continuous basis. Forces acting on the wearing part, or the tool, affect the wearing-part holder and, after a considerable period of use, the wearing-part holder may also need to be changed. Traditionally, the wearing-part holder is welded to the cutter head or is mounted thereon using another thermal joining technique. However, it is also conceivable that the wearing-part holder is mounted using a screw joint, cotter joint or other mechanical method of assembly. It may also be that the tooth is mounted directly on the cutter head.

Patent document WO 2010/111015 A2 describes a locking system for locking a stabilized excavating tooth to an adapter. The patent document describes a mainly hollow excavating tooth designed with a first opening and a second opening, where the openings are designed in the walls of the excavating tooth, with the excavating tooth designed to surround an adapter with a cavity running through the adapter. When the excavating tooth is arranged on the adapter, an assembly hole is defined by the first opening of the excavating tooth, the adapter cavity and the second opening of the excavating tooth, through which a locking pin can be mounted. The locking pin is mounted through the first opening, through the adapter and into the second opening of the excavating tooth. The described excavating tooth is designed with two holes for mounting a locking pin, which means that the excavating tooth is sensitive to abrasive or other erosive or grinding influences from sediment of a grinding nature which, when working with the excavating tooth, will cause wear to the locking pin and the mounting holes.

U.S. Pat. No. 5,956,874 describes an excavating tooth arranged with a pocket which has an inner, an upper, a lower and two opposite side walls with two contact surfaces arranged mainly parallel to each other to prevent rotation of the excavating tooth around the holder of the excavating tooth. The described excavating tooth is designed with two holes for mounting a locking pin, which means that the excavating tooth is sensitive to abrasive, or other erosive or grinding influences from sediment of a grinding nature which, when working with the excavating tooth, will cause wear to the locking pin and the mounting holes.

Known teeth for dredging have been shown to be sensitive to working or dredging sediment of a grinding nature.

The invention intends to solve the above problems through the development of a tooth with an improved protection against wear from sediment, designed with an easily releasable lock to fix a tooth/wearing part to a wearing-part holder securely, simply and permanently.

It is desirable to provide the technical field with a wearing part having improved protection against wear from sediment, designed with improved retention, secured and/or fixed mounting or arrangement of a wearing part on a holder.

The invention relates, according to an aspect thereof, to a wearing-part holder, where the wearing-part holder comprises a first stop surface, which is arranged on the front portion of the wearing-part holder, a first contact surface and a second contact surface symmetrically arranged from a centre line L-L from the first stop surface of the wearing-part holder to a second stop surface and a third stop surface, where the second stop surface and the third stop surface are symmetrically arranged on each side of the centre line L-L from the first contact surface and the second contact surface to a third contact surface and a fourth contact surface, where the third contact surface and the fourth contact surface are symmetrically arranged on each side of the centre line L-L from the second stop surface and the third stop surface.

According to further aspects of the improved wearing-part holder, provision is made as follows:

the first contact surface and the second contact surface are symmetrically arranged from a centre line L-L, from the front portion of the wearing-part holder, at the first stop surface, extending to a position X, and where the second stop surface and the third stop surface are symmetrically arranged on each side of the centre line L-L, extending from position X to position Y, where position Y is at a longer distance in the longitudinal direction of the wearing-part holder, along the centre line L-L, from the front portion of the wearing-part holder compared to position X, and where the third contact surface and the fourth contact surface are symmetrically arranged on each side of the centre line L-L, extending from position Y to position Z, where position Z is at a longer distance in the longitudinal direction of the wearing-part holder, along the centre line L-L, from the front portion of the wearing-part holder compared to position Y;

a fifth contact surface is arranged at the tip of the wearing-part holder from the front portion of the wearing-part holder to a position V, where position V is arranged with a longer distance from the front portion of the wearing-part holder compared to position Z;

the wearing-part holder is arranged with a fourth stop surface, which is arranged along the centre line L-L from position X to position Y;

the wearing-part holder is arranged with a fifth stop surface, which is arranged from position V to position W where the fifth stop surface is arranged at right angles from the fifth contact surface;

the first contact surface, the second contact surface, the second stop surface, the third stop surface, the fourth stop surface, the third contact surface and the fourth contact surface are arranged on the opposite side of the wearing-part holder relative to the fifth contact surface;

the first stop surface, the first contact surface, the second contact surface, the second stop surface, the third stop surface, the fourth stop surface, the third contact surface, the fourth contact surface, the fifth contact surface and the fifth stop surface are bound together with clearance surfaces arranged between the stop surfaces and the contact surfaces.

The invention also relates to a wearing part arranged to fit a wearing-part holder, where the wearing part is arranged with an opening.

According to further aspects of the improved wearing part, provision is made as follows:

the wearing part is a tooth for dredging, where the wearing part covers a first section, a second section and a third section of the wearing-part holder.

The invention also relates to a wearing-part system comprising a wearing-part holder, a wearing part, and a lock.

According to further aspects of the improved wearing-part system, provision is made as follows:

a lock comprising a threaded rod is arranged on a catch, where an elastomer is arranged with a through-hole through which the threaded rod runs; a mounting nut which is arranged on the threaded rod, where a first washer is arranged between the elastomer and the mounting nut and a second washer is arranged between the elastomer and the wearing-part holder.

BRIEF DESCRIPTION OF FIGURES

The invention is described in more detail below with reference to the attached figures, in which.

DETAILED DESCRIPTION

Figure 1:
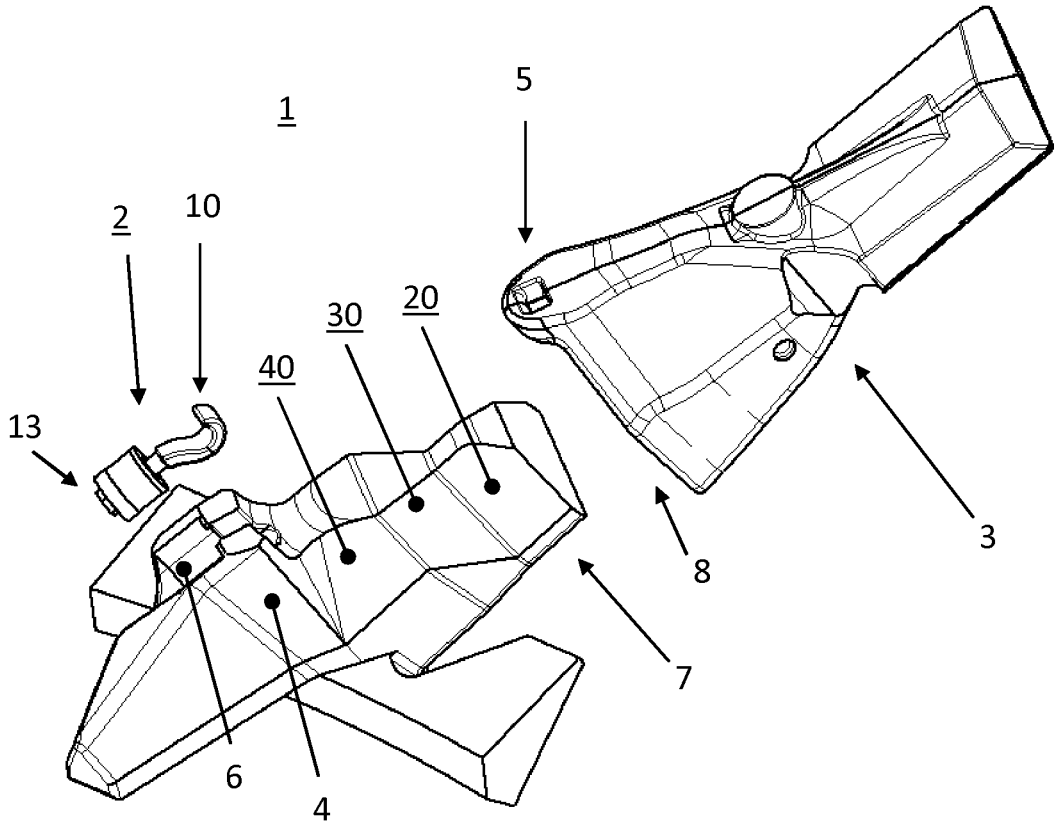
FIG. 1 shows the components in a wearing-part system according to an embodiment of the invention.

FIG. 1 shows the components included in a wearing-part system 1 according to one of the embodiments. A wearing part 3, or another form of tool or tooth, is arranged or mounted on a wearing-part holder 4, also referred to as holder, tool holder or adapter. The wearing part 3 can also be mounted directly on the cutter head or the apparatus using the wearing part, in which case the wearing-part holder 4 is a part of the cutter head or the apparatus. The wearing part 3 is mounted with a lock 2 which locks the wearing part 3 to the wearing-part holder 4. When the wearing part 3 is a tooth, the tooth 3 will be changed when the degree of wear is such that the tooth 3 needs to be replaced. When the wearing part 3 is replaced, it is important that the replacement of the wearing part 3 is easy to carry out and that locking is such that the wearing part is permanently retained on the wearing-part holder 4 and that the replacement is safe to carry out. Traditionally, different types of locking methods have been used, for example different types of wedges or welded joints.

The lock 2 shown in FIG. 1 consists of or comprises a catch 10 which is arranged in an opening 5 designed in the wearing part 3, which opening 5 can also be referred to as aperture. The catch 10, which is designed as a hook, retains the wearing part 3 on the wearing-part holder 4. The lock 2 is arranged in a lock holder 6 on the wearing-part holder 4. The lock also includes a threaded rod 1 which is preferably designed as one piece together with the catch 10. Moreover, an elastomer 12 is included, which is preferably designed as a cylinder with a through-hole through which the threaded rod 11 runs. The elastomer 12 is preferably made of an elastically deformable material such as an elastomer, such as rubber, or in the form of a soft metal.

A mounting nut 13 is arranged on the threaded rod 11. Moreover, a first washer 14 is arranged between the elastomer and the mounting nut 13 and a second washer 15 is arranged between the elastomer 12 and the wearing-part holder 4. When the wearing part 3 is placed on the wearing-part holder 4, the tip 7 formed on the wearing-part holder 4 fits into a recess 8 formed on the wearing part 3, and, when the tip 7 is fully inserted into the recess 8, the lock 2 is placed in the lock holder 6, or, the lock 2 is already placed in the lock holder 6, so that the catch 10 is arranged in the opening 5 of the wearing part 3. By rotating the mounting nut 13, the wearing part 3 can be locked to the wearing-part holder 4.

Figure 2:
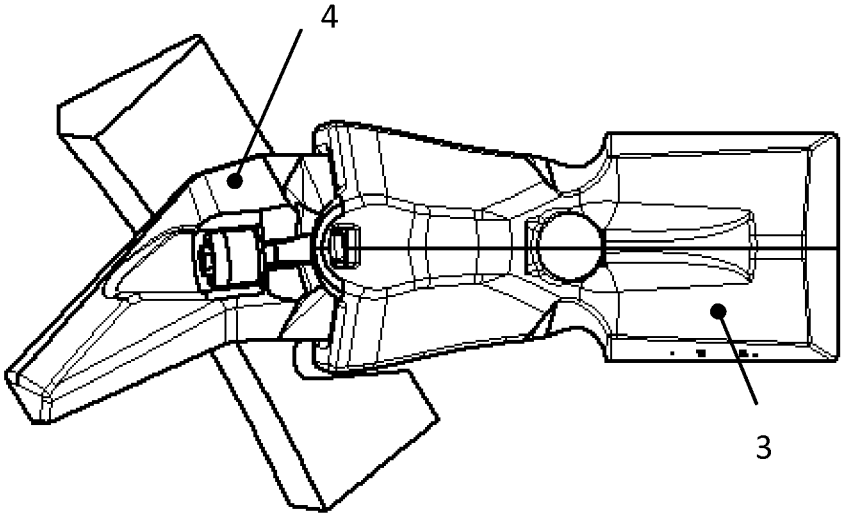
FIG. 2 shows a wearing-part system in an assembled state in a view from above according to an embodiment of the invention.

FIG. 2 shows an assembled wearing-part system 1. A wearing part 3 is mounted on a wearing-part holder 4. The lock 2 is tightened, which means that the elastomer 12 is compressed or otherwise loaded to achieve a tightening effect for retaining the wearing part 3 on the wearing-part holder 4.

Figure 3:
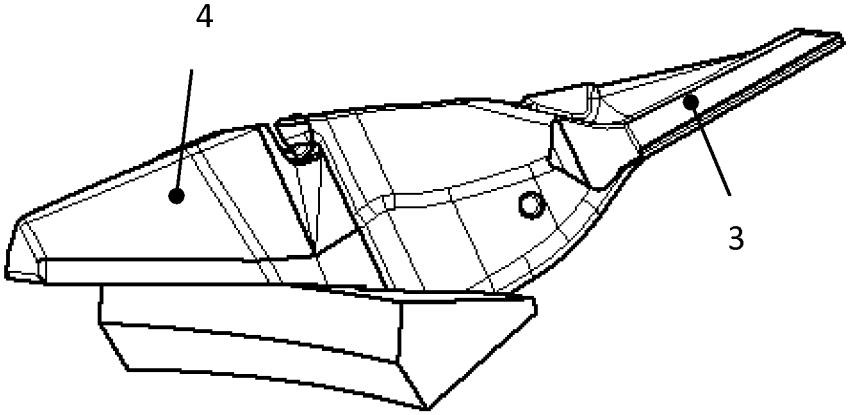
FIG. 3 shows a wearing-part system in an assembled state in a view from the side according to an embodiment of the invention.

FIG. 3 shows a further view of an assembled wearing-part system 1. A wearing part 3 is mounted on a wearing-part holder 4. Lock 2 is designed to fix or retain a wearing part 3 on a tool holder 4. Retaining or being retained means that the wearing part 3 is mounted on or arranged on the tool holder 4 in a permanent manner. Initially, the wearing part 3 is almost fixed to the tool holder 4, but as wear occurs, the wearing part 3 can be arranged more loosely, or with some play, on the tool holder 4. Regardless of whether the wearing part 3 is fixed or somewhat moveably arranged on the tool holder 4, the wearing part 3 will not come off or otherwise be removed from the tool holder 4, thus the wearing part 3 is retained on the tool holder 4.

Figure 4:
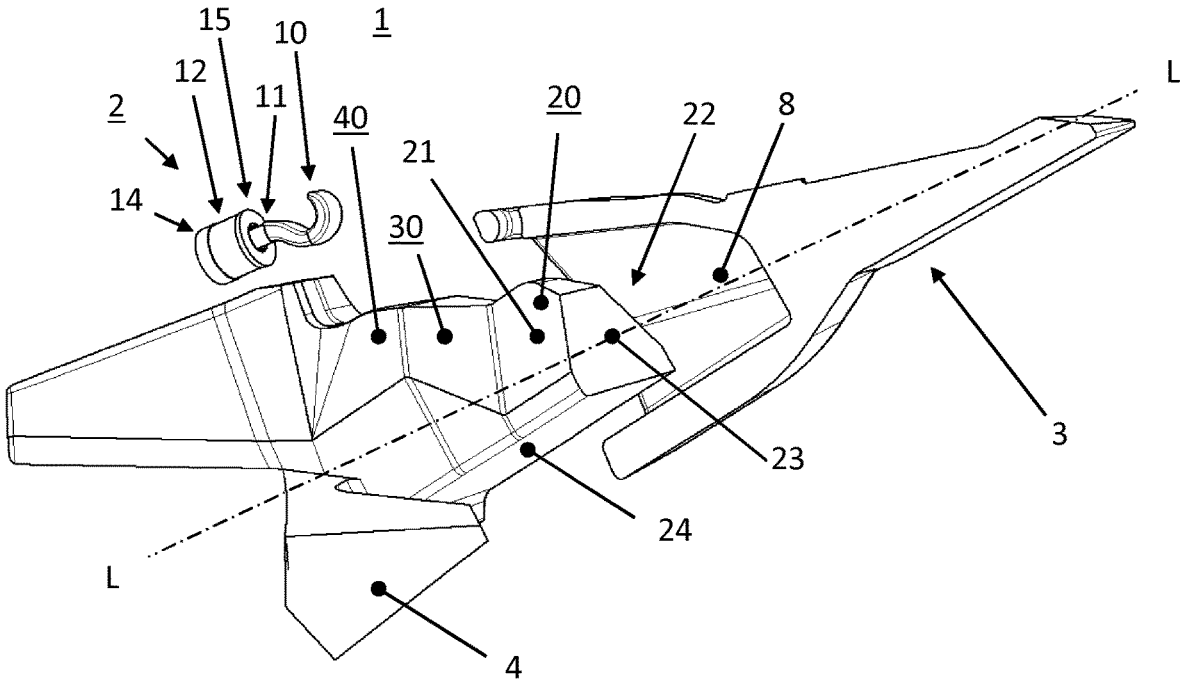
FIG. 4 shows the components of a wearing-part system in a view from the side according to an embodiment of the invention.

FIG. 4 shows a view of a wearing-part system 1 not yet assembled, where the wearing part 3, the wearing-part holder 4 and the lock 2 are separate from each other. The tip 7 of the wearing-part holder 4 is formed with three sections, a first section 20, adjacent the outer end portion of the tip 7, a second section 30 and a third section 40, where the second section 30 is arranged between the first section 20 and the third section 40. The first section 20 and the third section 40 mainly have a contacting function against the wearing part 3, while the second section 30 mainly has a stopping function against the wearing part 3. The first section 20 is formed with a first contact surface 21 and a second contact surface 22 and a stop surface 23 which is formed in the nose or the tip of the wearing-part holder 4.

Figure 5A:
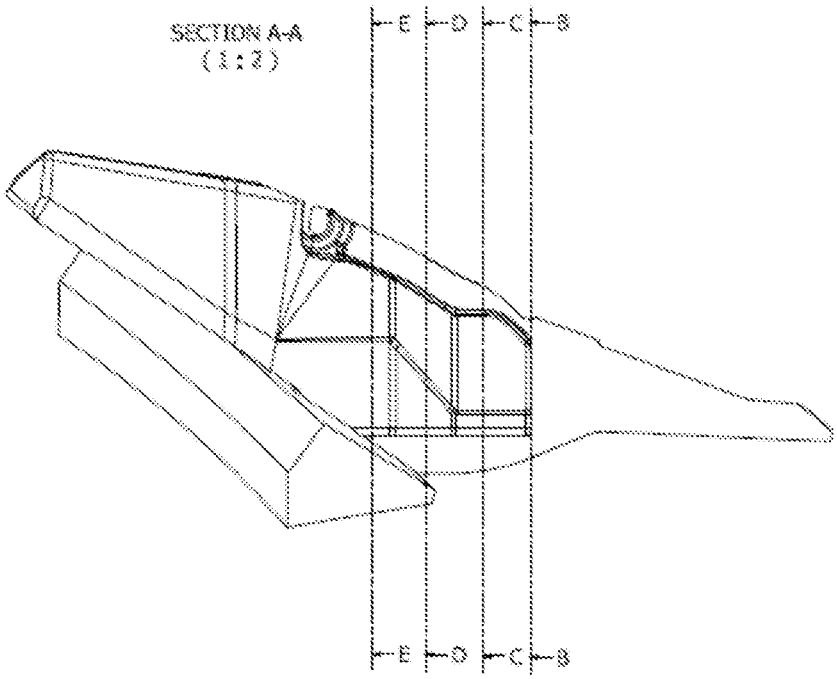
FIG. 5*a* shows a wearing-part system in an assembled state in a view from the side with marked section surfaces according to an embodiment of the invention.

FIG. 5*a* shows a wearing-part system 1 in an assembled state in a view from the side with marked section surfaces. The section surface B-B is at the position where the stop surface 23 of the wearing-part holder 4 meets the inner bearing surface of the wearing part. The section surface C-C is at a position on the first section 20. The section surface D-D is at a position on the second section 30. The section surface E-E is at a position on the third section 40.

Figure 5B:
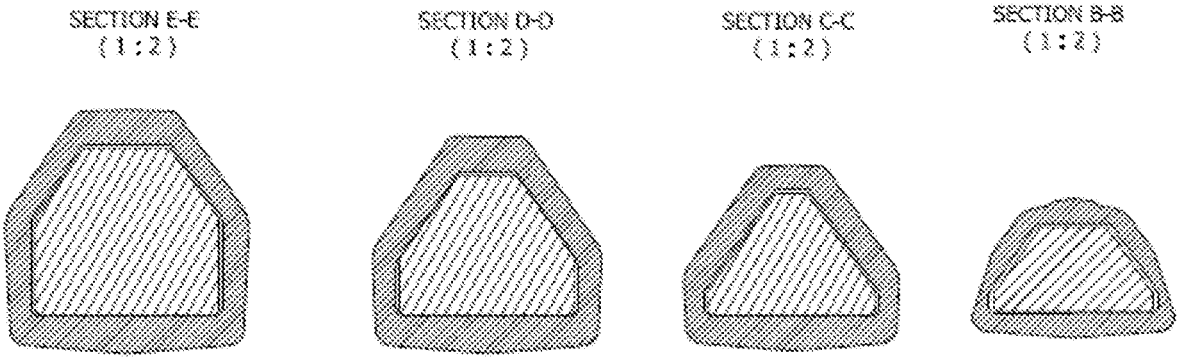
FIG. 5*b* shows section surfaces in an assembled wearing-part system according to an embodiment of the invention.

FIG. 5*b* shows the section surfaces in a wearing-part system at the different positions described above. The section surfaces E-E, D-D, C-C and B-B are shown in the figure. The wearing-part holder 4 meets the wearing part 3 with a stop surface or a bearing surface. The other surfaces of the wearing-part holder 4 that do not contact the wearing part 3 are referred to as clearance surfaces. Therefore, the surfaces arranged on the wearing-part holder are of the type stop surface, bearing surface or clearance surface. Parts of the cross section C-C of the first section 20 have the same cross-sectional area across parts of the longitudinal extension of the first section 20. The cross section D-D of the second section 30 has a cross-sectional area which increases from position X to position Y. In position X, the cross-sectional area of the second section 30 is identical with the cross-sectional area of the first section 20. In position Y, the cross-sectional area of the second section 30 is identical with the cross-sectional area of the third section 40. Since the cross-sectional area of the third section 40 is greater than the cross-sectional area of the first section 20, it means that the cross-sectional area of the second section 30 is increasing from position X to position Y.

Figure 6A:
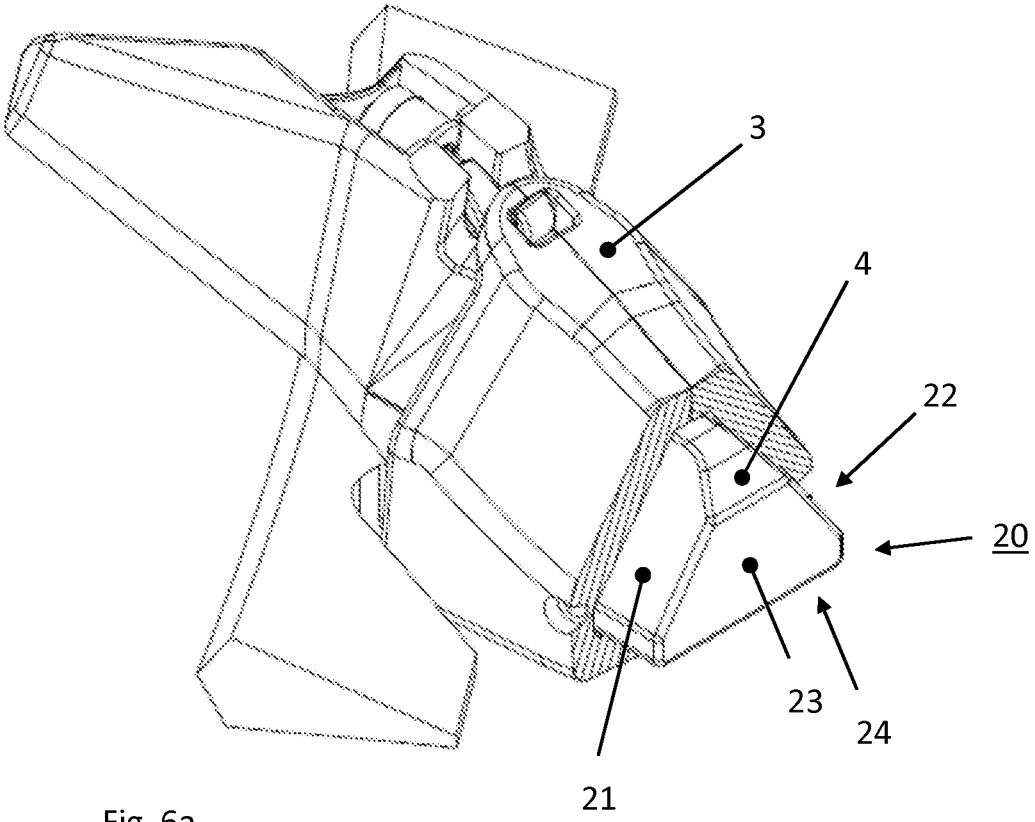
FIG. 6*a* shows a wearing-part system in an assembled state where the wearing part is designed with a section in position C-C revealing the wearing-part holder according to an embodiment of the invention.

FIG. 6*a* shows a wearing-part system 1 where the wearing part 3 is formed with a section in position C-C, where a section of the wearing part 3 is not shown in the figure, which means that parts of the wearing-part holder 4 are visible. The first section 20 is formed with a first contact surface 21 and a second contact surface 22 and a first stop surface 23 which is formed in the nose or the tip of the wearing-part holder 4. Passing the first section 20, the second section 30 and the third section 40 is the primary contact surface 24. Any other surfaces shown in the first section 20 are clearance surfaces.

Figure 6B:
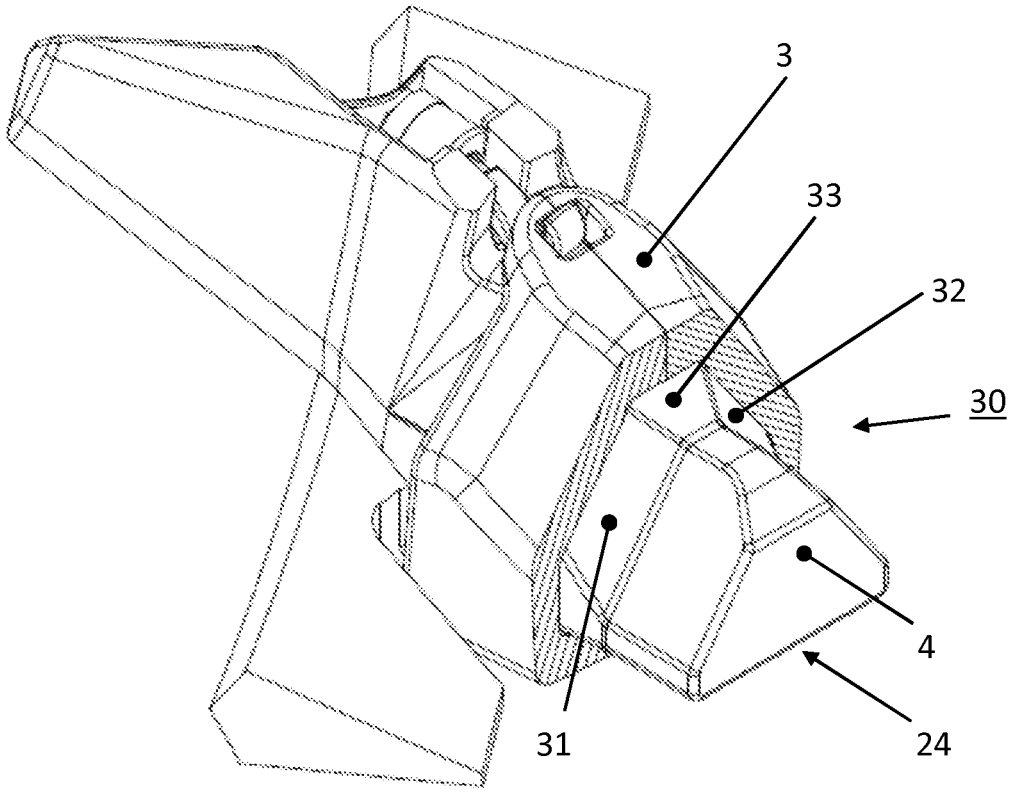
FIG. 6*b* shows a wearing-part system in an assembled state where the wearing part is designed with a section in position D-D revealing the wearing-part holder according to an embodiment of the invention.

FIG. 6*b* shows a wearing-part system 1 where the wearing part 3 is formed with a section in position D-D, where a section of the wearing part 3 is not shown in the figure, which means that parts of the wearing-part holder 4 are visible. The second section 30 is formed with a second stop surface 31, a third stop surface 32 and a fourth stop surface 33 which are formed intermediate the second stop surface 31 and the third stop surface 32 on the wearing-part holder 4. The primary contact surface 24 also passes the second section 30. Any other surfaces shown in the second section 30 are clearance surfaces.

Figure 6C:
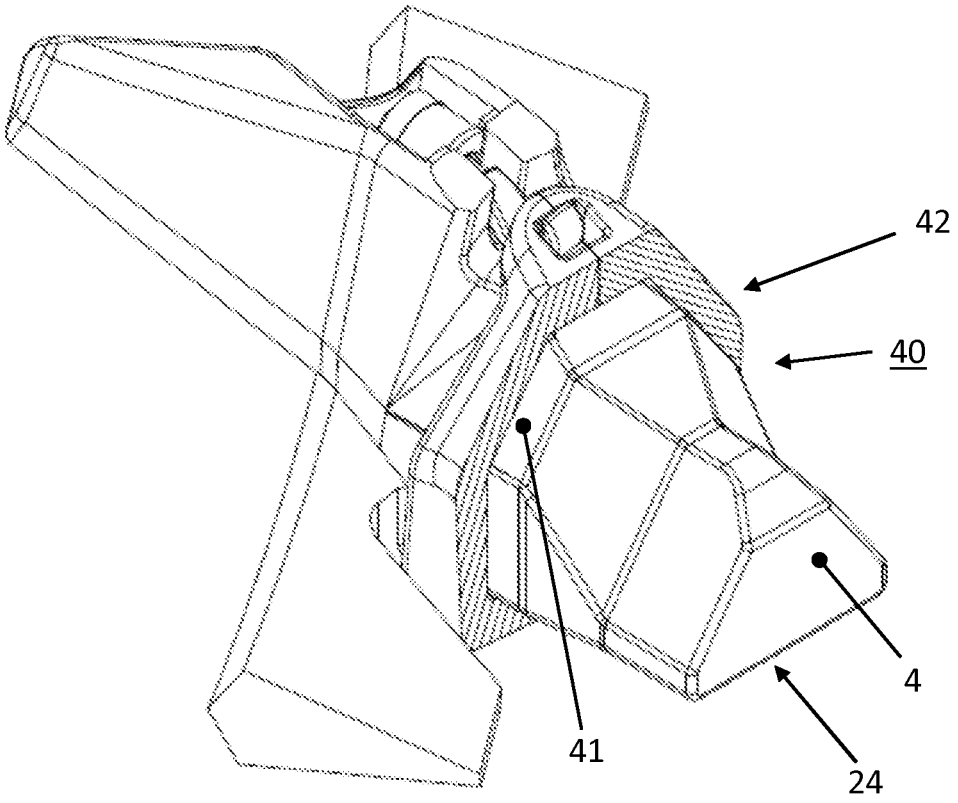
FIG. 6*c* shows a wearing-part system in an assembled state where the wearing part is designed with a section in position E-E revealing the wearing-part holder according to an embodiment of the invention.

FIG. 6*c* shows a wearing-part system 1 where the wearing pan 3 is formed with a section in position E-E, where a section of the wearing part 3 is not shown in the figure, which means that parts of the wearing-part holder 4 are visible. The third section 40 is formed with a third contact surface 41 and a fourth contact surface 42 which are formed in the third section 40 on the wearing-part holder 4. The primary contact surface 24 also passes the third section 40. Any other surfaces shown in the third section 40 are clearance surfaces.

Figure 7:
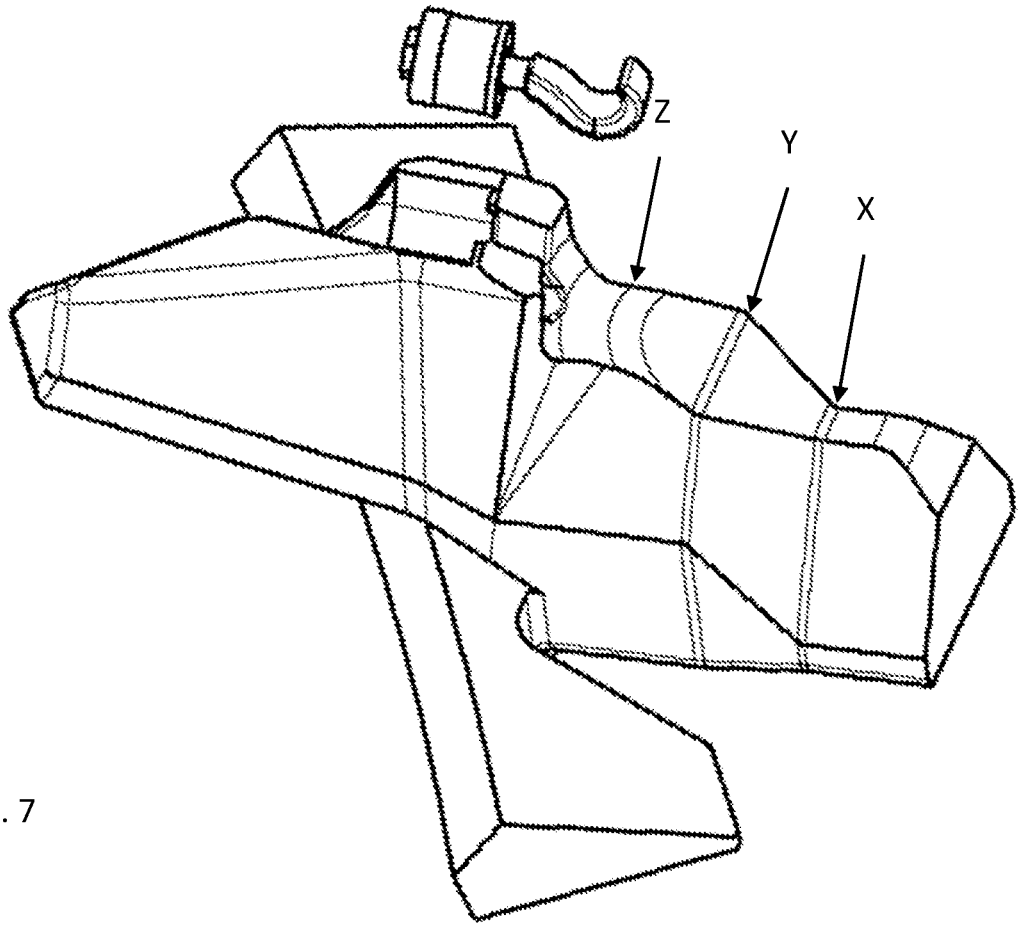
FIG. 7 shows a wearing-part holder according to an embodiment of the invention.

FIG. 7 shows a wearing-part holder 4 with indicated positions where the various sections start and end respectively. Positions can also be referred to as site, location or point and form a certain position on the wearing-part holder 4. Position X is the position where the first section 20 transitions to the second section 30. The first section 20 extends in the longitudinal direction of the wearing-part holder 4 from the front portion of the wearing-part holder 4, where the first stop surface 23 is arranged, to position X. The second section 30 extends in the longitudinal direction of the wearing-part holder 4 from position X to position Y. The third section extends in the longitudinal direction of the wearing-part holder 4 from position Y to position Z.

Figure 8:
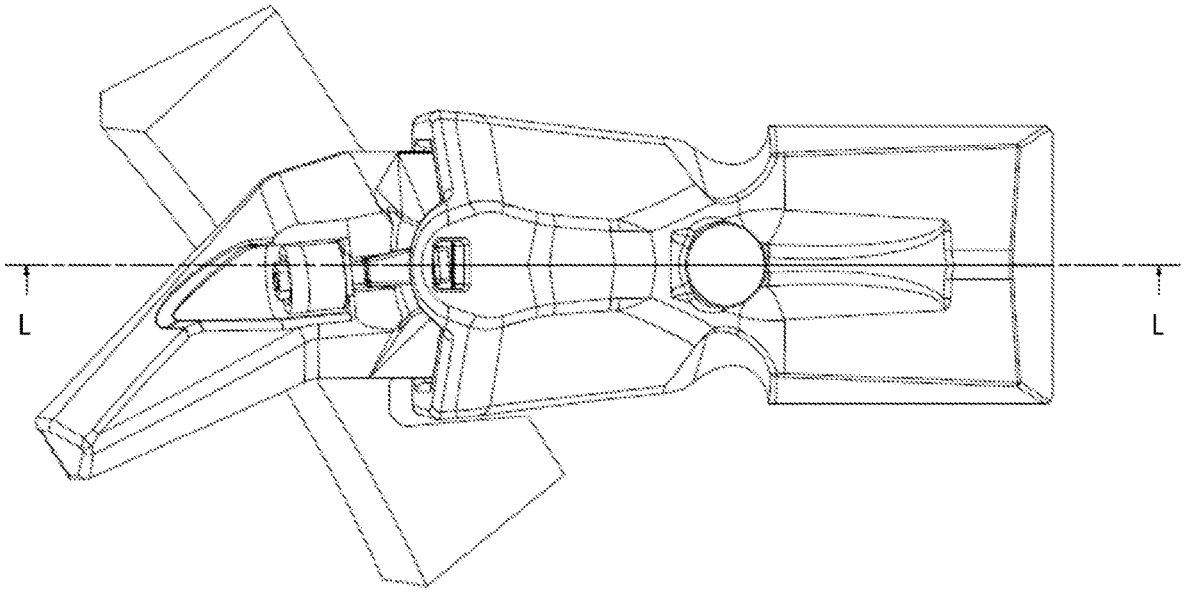
FIG. 8 shows a wearing-part system in an assembled state in a view from above according to an embodiment of the invention.

FIG. 8 shows the centre line L-L for a wearing-part system 1. The centre line L-L runs in the longitudinal direction of the wearing part and the wearing-part holder.

Figure 9A:
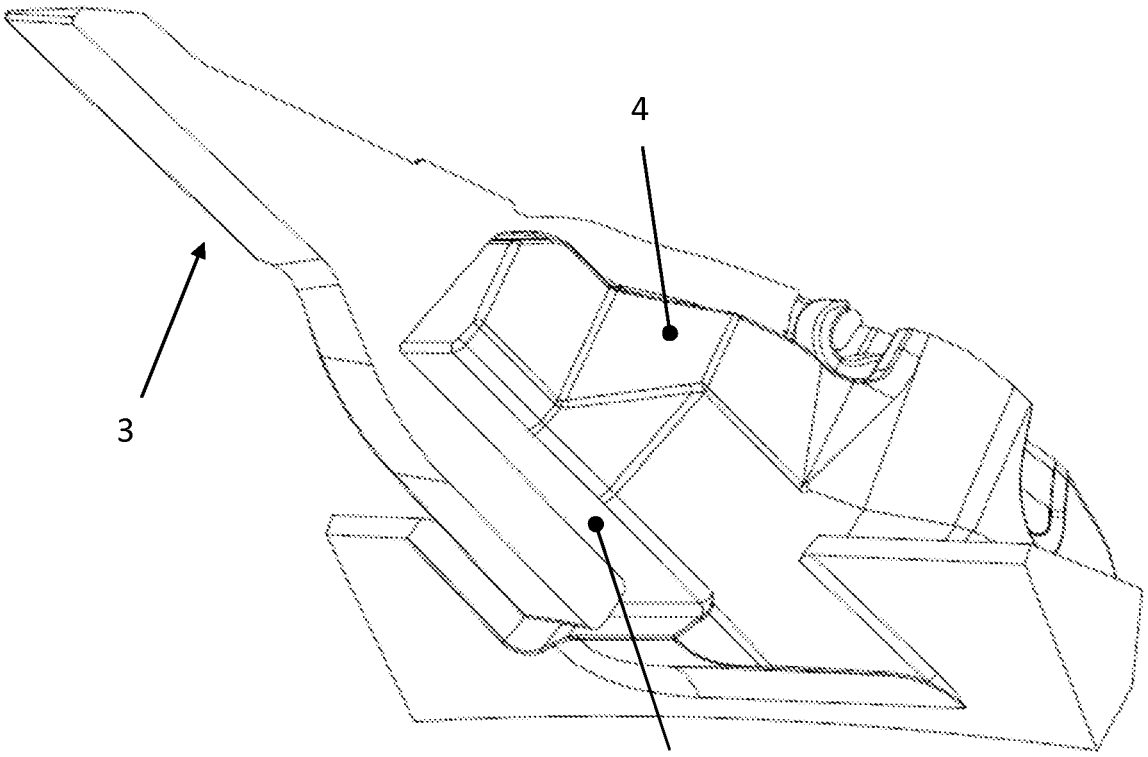
FIG. 9*a* shows a wearing-part system in an assembled state where the wearing part is designed with a section revealing the underside of the wearing-part holder according to an embodiment of the invention.

FIG. 9*a* shows a wearing-part holder 4 with indicated positions where the various sections start and end respectively. Position V is the position where the fifth bearing surface 24, the primary bearing surface, ends. The fifth bearing surface 24 extends in the longitudinal direction of the wearing-part holder 4 from the front portion of the wearing-part holder 4, where the first stop surface 23 is arranged, to position V.

Figure 9B:
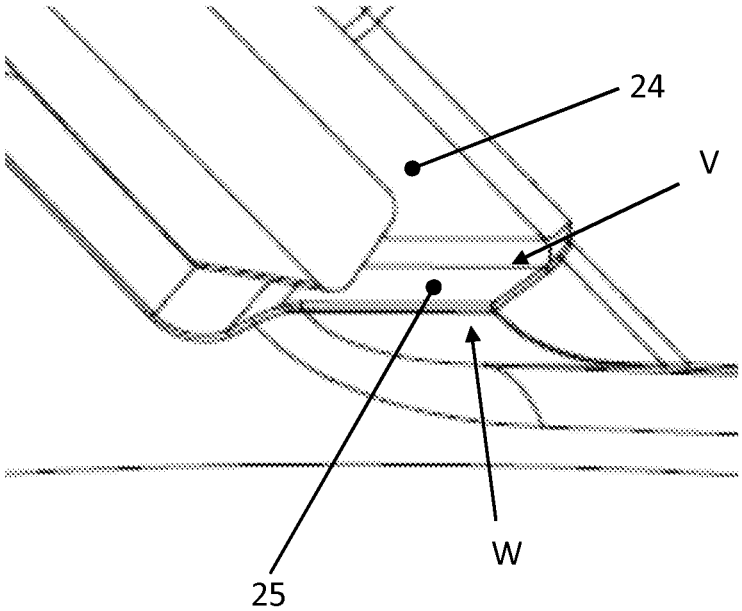
FIG. 9*b* shows an enlarged view of a part of FIG. 9*a*.

FIG. 9*b* shows an enlarged part of FIG. 9*a*. Position V is the position where the fifth stop surface 25 starts. The fifth stop surface 25 extends at right angles relative to the longitudinal direction of the wearing-part holder 4, at right angles from the fifth bearing surface 24 to position W.

When a wearing part 3, for example a tooth for dredging, is arranged, for example mounted, on a wearing-part holder 4, the catch 10 of the lock 2 can be arranged on a recess or an opening 5. In the following description of function, the term wearing part is used to describe the invention. However, any wearing part or tooth or dredging tooth can be used in a corresponding manner. For example, a wearing part can be an end board protection, a cutting blade protection, a loading tooth, an excavating tooth, a ripper, a deep pocket tooth or a bucket tooth.

When a wearing part 3 is arranged on the wearing-part holder 4, the tip 7 of the wearing-part holder 4 meets a recess 8 on the wearing part 3. The wearing part 3 is arranged on the wearing-part holder 4 so that the recess 8 of the wearing part 3 meets the tip 7 of the wearing-part holder 4, where the tip 7 comprises the first section 20, the second section 30 and the third section 40 of the wearing-pan holder 4. The wearing part 3 is designed to cover, or to protect, the wearing-part holder 4. The first section 20 is formed with a first contact surface 21 and a second contact surface 22 and a first stop surface 23 which is formed in the nose or the tip of the wearing-part holder 4. Passing the first section 20, the second section 30 and the third section 40 is the fifth contact surface 24. The second section 30 is formed with a second stop surface 31, a third stop surface 32 and a fourth stop surface 33 which are formed in the second section 30 on the wearing-part holder 4. The third section 40 is formed with a third contact surface 41, a fourth contact surface 42 and a fifth stop surface 25. When the wearing part 3 is arranged on the wearing-part holder 4, the wearing part protects the wearing-part holder 4 and the lock 2 from wear through the design of the wearing part 3 with a covering or protective function for the wearing-part holder 4 and the lock 2.

The first contact surface 21, second contact surface 22, third contact surface 41, fourth contact surface 42 and fifth contact surface 24 formed on the wearing-part holder meet corresponding contact surfaces in the wearing part 3 when the wearing part 3 is arranged on the wearing-part holder 4.

In the same way, the first stop surface 23, second stop surface 31, third stop surface 32, fourth stop surface 33 and fifth stop surface 25 formed on the wearing-part holder meet corresponding stop surfaces arranged in the wearing part 3 when the wearing part 3 is arranged, or mounted, on the wearing-part holder 4.

The contact surfaces, the first contact surface 21, second contact surface 22, third contact surface 41, fourth contact surface 42 and fifth contact surface 24, are arranged to meet the forces applied to the wearing part 3 when the wearing part is used for dredging or other work. When the wearing part 3 meets the material being worked, the main part of the forces during work will, from the wearing part 3, meet the fifth contact surface 24, the primary contact surface, on the wearing-part holder 4. Therefore, it is relevant that the fifth contact surface 24 is relatively large in order to establish a large contact surface between the wearing part 3 and the wearing-part holder 4 to enable transmission of forces from the wearing part 3 to the wearing-part holder 4. Moreover, the stop surfaces, the first stop surface 23, the second stop surface 31, the third stop surface 32, the fourth stop surface 33 and the fifth stop surface 25, are arranged to define the correct position between the wearing part 3 and the wearing-part holder 4. Other surfaces, clearance surfaces, are arranged to enable installation and removal, such as mounting and dismantling, of the wearing part 3 on/from the wearing part holder 4.

According to a preferred embodiment, when the wearing part 3 is worn and needs replacing, the lock 2 is dismantled by loosening and moving the mounting nut 13 on the threaded rod 11 so that the elastomer 12 is released. When the mounting nut 13 is moved to a position so that the lock 2 can be released, the lock is lifted out of the lock holder 6 and the catch 10 can be moved out of the opening 5. Then the wearing part 3 can be removed from the wearing-part holder 4. The lock 2 can then be reused to mount a wearing part 3 on a wearing-part holder 4 again. If the elastomer 12 has lost its resilience, the mounting nut 13 can be fully removed, after which the first washer 14, the elastomer 12 and the second washer 15 are removed from the threaded rod. Then the second washer 15, a new elastomer 12 and the first washer 14 are refitted, after which the mounting nut 13 is threaded again on the threaded rod 11.

An example of an embodiment of the wearing-part system 1 consists of or comprises a lock 2, where the lock 2 is arranged between a wearing part 3 and a wearing-part holder 4 and locks the wearing part 3 to the wearing-part holder 4. Each apparatus or tool, for example a cutter head, has a plurality of wearing-part systems 1 mounted on the apparatus. According to an embodiment, the wearing-part holders 4 are welded onto the cutter head and can be dismantled from the cutter head if the wearing-part holder 4 needs replacing. The wearing-part system 1, and thus the locking system 2, can be adapted to all sizes of wearing parts 3 and to all types of applications of teeth, excavating teeth, wearing-part systems and tools. The teeth can be replaced continuously by the operator of the dredger in a safe and simple manner.

In an alternative embodiment, other devices can be used to lock the wearing part 3 to the wearing-part holder 4, for example various forms of cotter joints or other variants of screw joints.

The invention claimed is:

1. Wearing-part holder, where a tip of the wearing-part holder comprises a first section with a first stop surface, which is arranged on a front portion of the tip of the wearing-part holder, a first contact surface and a second contact surface symmetrically arranged from a centre line L-L of the wearing-part holder, from the first stop surface to a second section with a second stop surface and a third stop surface, where the second stop surface and the third stop surface also are symmetrically arranged on each side of the centre line L-L, from the first contact surface and the second contact surface to a third section with a third contact surface and a fourth contact surface, where the third contact surface and the fourth contact surface also are symmetrically arranged on each side of the centre line L-L, from the second stop surface and the third stop surface, wherein a fifth contact surface passes the first, second, and third sections in a longitudinal direction of the wearing-part holder, and wherein the first contact surface, the second contact surface, the second stop surface, the third stop surface, a fourth stop surface, the third contact surface, and the fourth contact surface are arranged on an opposite side of the wearing-part holder relative to the fifth contact surface.

2. Wearing-part holder according to claim 1, where the first contact surface and the second contact surface extend to a position X, where the first section transitions into the second section, and where the second section with the second stop surface and the third stop surface extend from the position X to a position Y, where the second section transitions into the third section, where the position Y is at a longer distance from the first stop surface compared to the position X, and where the third contact surface and the fourth contact surface extend from the position Y to a position Z, where the third section ends, and the position Z is at a longer distance from the first stop surface compared to the position Y.

3. Wearing-part holder according to claim 1, where the fifth contact surface extends from the front portion of the tip of the wearing-part holder to a position V, where the fifth contact surface ends, and the position V is arranged with a longer distance from the first stop surface compared to a position Z.

4. Wearing-part holder according to claim 1, where the fourth stop surface is arranged in the second section from a position X, where the first section transitions into second section, to a position Y, where the second section transitions into the third section.

5. Wearing-part holder according to claim 1, where the wearing-part holder is arranged with a fifth stop surface, arranged at right angles from the fifth contact surface from a position V, where the fifth contact surface ends.

6. Wearing-part holder according to claim 1, where the first stop surface, the first contact surface, the second contact surface, the second stop surface, the third stop surface, the fourth stop surface, the third contact surface, the fourth contact surface, the fifth contact surface and the fifth stop surface are bound together with clearance surfaces arranged between the stop surfaces and the contact surfaces.

7. Wearing part arranged to fit the wearing-part holder according to claim 1, where the wearing part is arranged with an opening where the tip of the wearing-part holder is insertable into a recess in the wearing part.

8. Wearing part according to claim 7, wherein the wearing part is a tooth for dredging, where the wearing part covers the first section, the second section and the third section of the wearing-part holder.

9. Wearing-part system comprising the wearing-part holder according to claim 1, a wearing part arranged with an opening where the tip of the wearing-part holder is insertable into a recess in the wearing part, and a lock.

10. Wearing-part system according to claim 9, where the lock comprises a threaded rod arranged on a catch, an elastomer arranged with a through-hole through which the threaded rod runs, a mounting nut arranged on the threaded rod, a first washer arranged between the elastomer and the mounting nut and a second washer arranged between the elastomer and the wearing-part holder.

* * * * *